US006961977B2

(12) United States Patent
Seidler

(10) Patent No.: US 6,961,977 B2
(45) Date of Patent: Nov. 8, 2005

(54) MAGNETIC HINGE

(75) Inventor: David Seidler, Forest Hills, NY (US)

(73) Assignee: Concept Workshop Worldwide, LLC, New York, NY (US)

( * ) Notice: Subject to any disclaimer, the term of this patent is extended or adjusted under 35 U.S.C. 154(b) by 124 days.

(21) Appl. No.: 10/744,394

(22) Filed: Dec. 23, 2003

(65) Prior Publication Data

US 2004/0134037 A1 Jul. 15, 2004

Related U.S. Application Data

(63) Continuation of application No. 10/093,919, filed on Mar. 7, 2002, now abandoned.

(51) Int. Cl.[7] ..... A45D 33/00

(52) U.S. Cl. ..... 16/320; 132/293; 220/4.21; 220/4.26; 220/816

(58) Field of Search ..... 16/320; 132/293–296, 132/300–301, 305, 286–287; 220/4.21–4.27, 816, 820–824

(56) References Cited

U.S. PATENT DOCUMENTS 2,327,513 A * 8/1943 Leo ..... 132/301
3,188,157 A * 6/1965 Rand ..... 312/202
3,264,678 A * 8/1966 Parmelee ..... 16/228
3,392,868 A * 7/1968 Pfrommer ..... 220/520
4,239,308 A * 12/1980 Bradley ..... 312/201
4,513,974 A * 4/1985 Lin ..... 273/239
4,560,078 A * 12/1985 Dubuisson ..... 220/4.26
4,807,773 A * 2/1989 Tsai ..... 220/4.27
D328,817 S * 8/1992 Holland ..... D3/270
5,210,906 A * 5/1993 Aihara et al. ..... 16/232
5,246,020 A * 9/1993 Wu ..... 132/295
5,632,394 A * 5/1997 Mecca et al. ..... 220/824
6,070,749 A * 6/2000 Joulia ..... 220/4.22
6,145,515 A * 11/2000 Wu ..... 132/295
6,217,170 B1 * 4/2001 Hsiao ..... 351/153
6,223,921 B1 * 5/2001 Huang ..... 220/4.27
6,302,120 B1 * 10/2001 Kuo ..... 132/295
6,553,626 B2 * 4/2003 Coburn ..... 16/386

* cited by examiner

*Primary Examiner*—Robert J. Sandy
*Assistant Examiner*—Thomas Y. Ho
(74) *Attorney, Agent, or Firm*—Amster, Rothstein & Ebenstein

(57) ABSTRACT

A magnetic hinge defining a hinge axis includes first and second hinge plates of non-magnetic material and first and second magnets disposed therein, respectively, for movement therewith. The plates are generally parallel and independently pivotable about the hinge axis between a closed orientation, wherein the plates are essentially superposed, and an open orientation, wherein the plates are essentially not superposed. The first and second magnets are essentially superposed, generally coaxial with the hinge axis, and in the same magnetic orientation.

42 Claims, 12 Drawing Sheets

FIG. 6
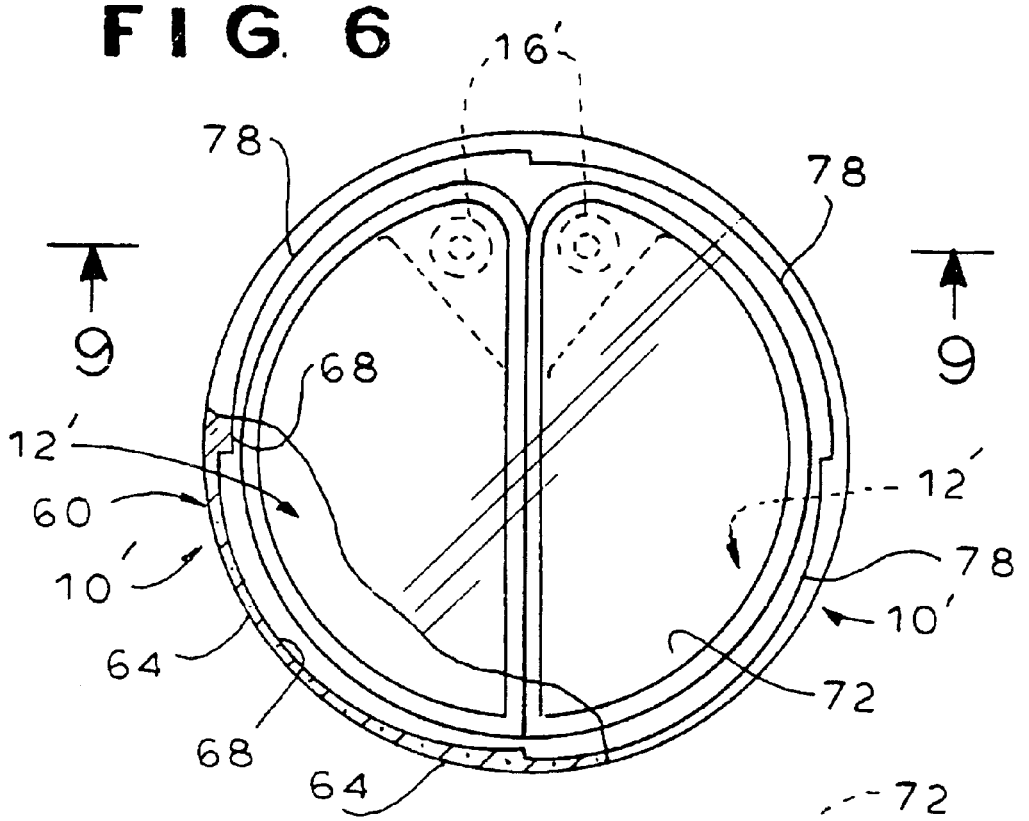
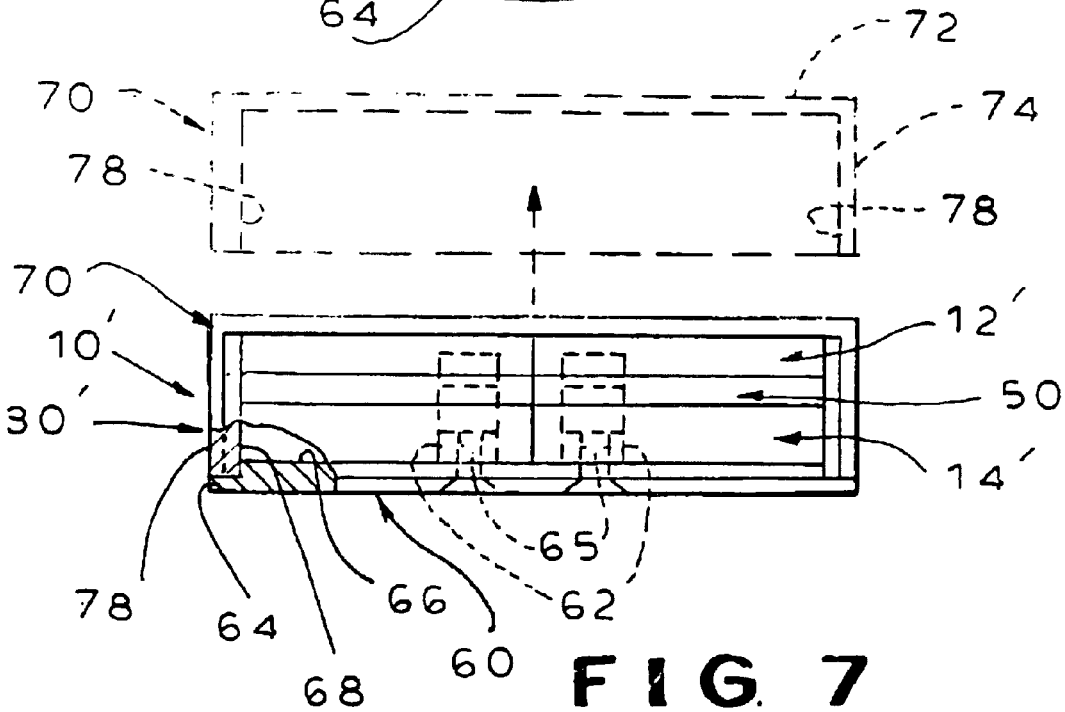
FIG. 7

FIG. 13
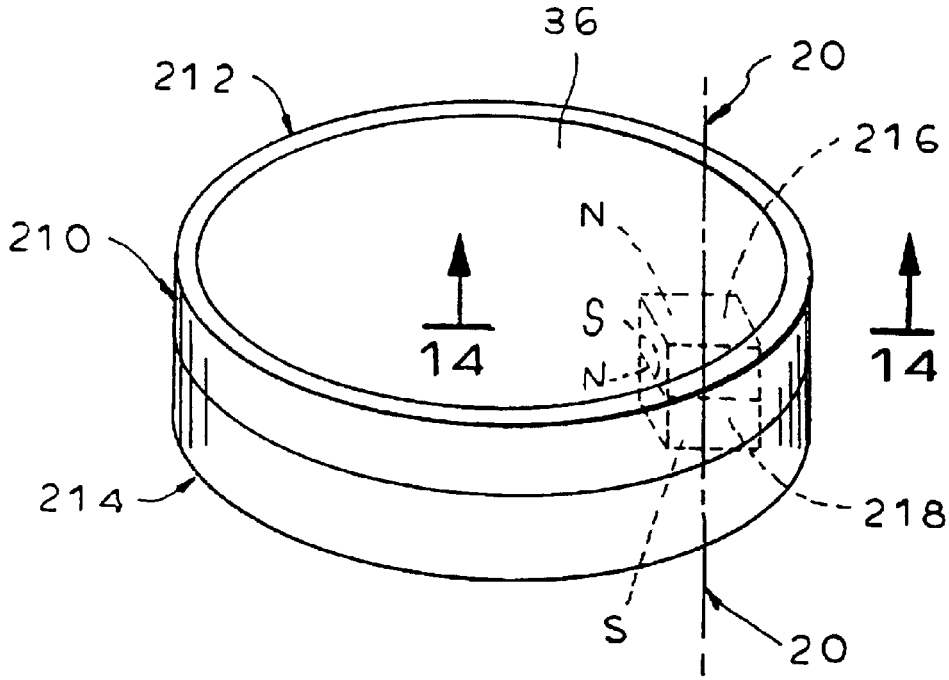
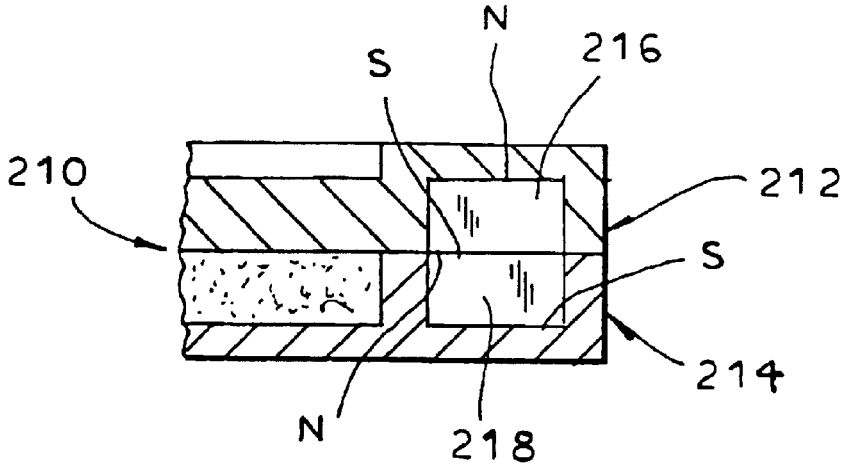
FIG. 14

FIG. 15
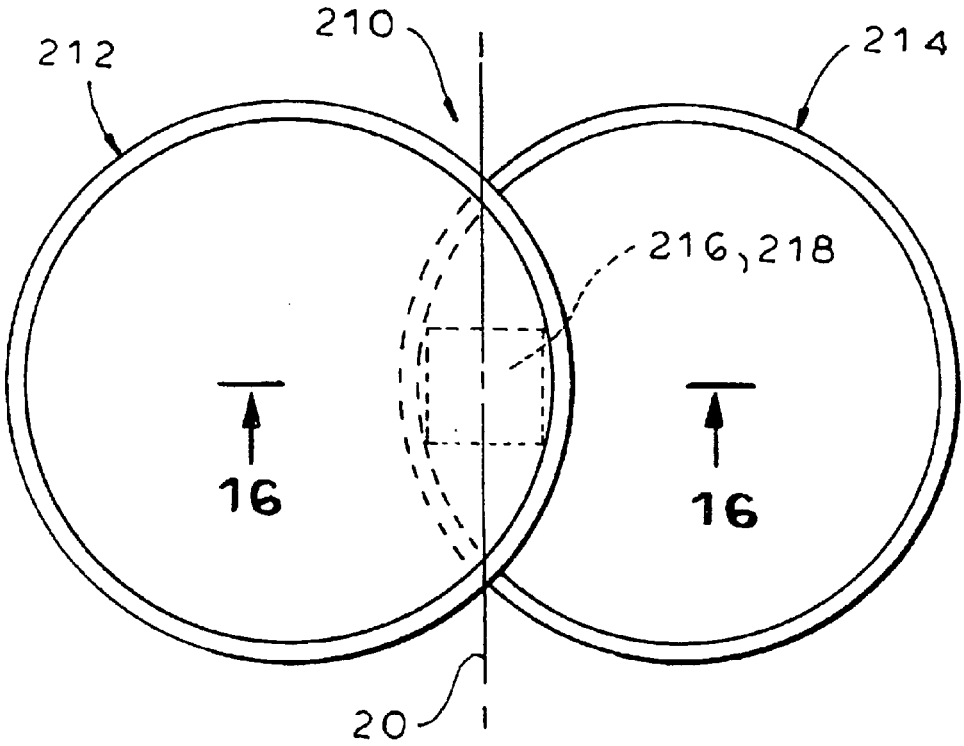
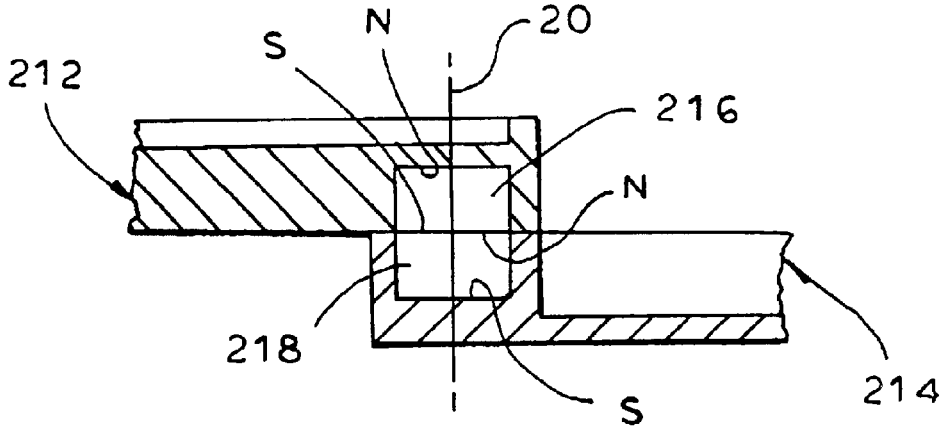
FIG. 16

FIG.17
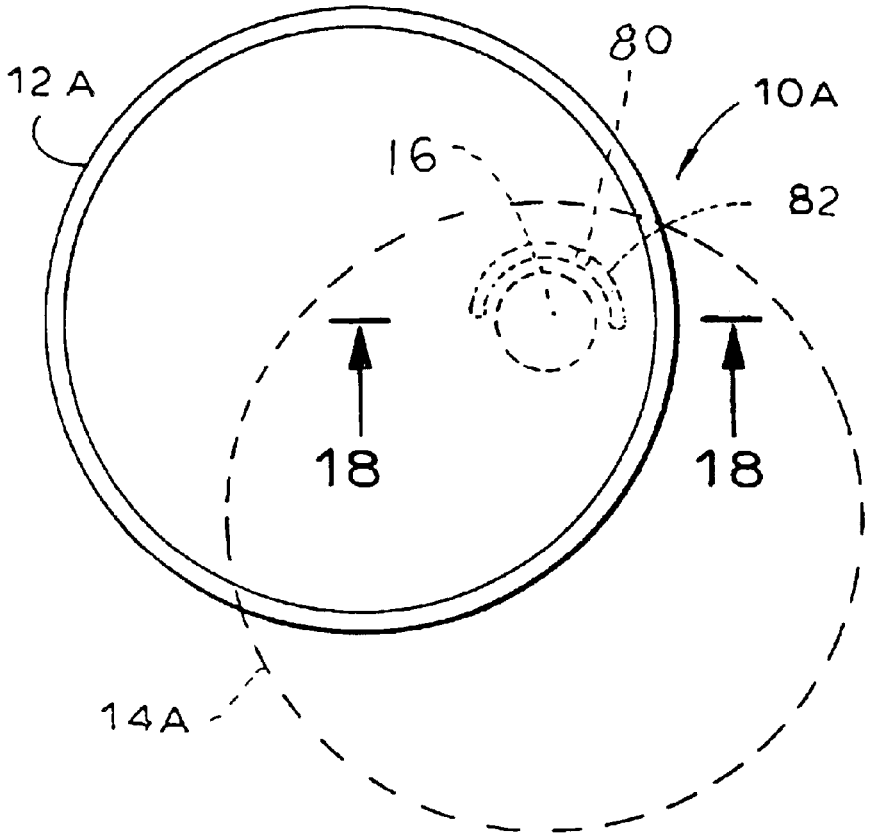
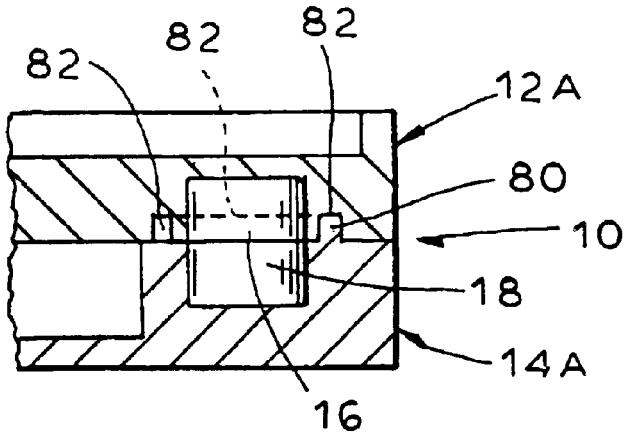
FIG.18

MAGNETIC HINGE

CROSS-REFERENCE TO RELATED APPLICATIONS

This is a continuation of U.S. patent application Ser. No. 10/093,919, filed Mar. 7, 2002 now abandoned.

BACKGROUND OF THE INVENTION

The present invention relates to a hinge, and more particularly to a magnetic hinge.

A conventional physical hinge consists of a pair of hinge plates in parallel plains pivotably secured together by a hinge pin enabling movement of the hinge plates between first and second orientations relative to one another. The hinge pin defines the common pivot axis of the hinge plates. For ease of reference, the first and second orientations are commonly referred to as the "closed" and "open" orientations. In the closed orientation the first and second plates substantially overlapping, while in the open orientation the first and second plates are substantially non-overlapping. While the conventional physical hinge typically performs well in a variety of different environments, it has not proven to be entirely satisfactory in particular environments for one or more of the following reasons:

1. The conventional physical hinge is either internally or externally hinged. When two structural components are externally hinged, the overall dimensions of the structural components (e.g., the hinge plates) must be increased to incorporate the physical hinge pin and also so that at least one edge of each structural component is at least partially wrapped around the common hinge pin; this is disadvantageous as it increases the size of the structure formed by the structural components. Where the structural components are internally hinged (that is, the physical hinge pin is either disposed between the structural components when the hinge is in the closed orientation or extends transversely through the structural components), some of the space between or extending through the structural components must be sacrificed to allow for the volume occupied by the physical hinge pin. In other words, the conventional physical hinge either limits the compactness of the structure employing it or requires a portion of the otherwise useable space within a structure be dedicated to the hinge pin.

2. The conventional physical hinge is not readily deconstructed—that is, in order to separate the hinge plates from one another, typically either the hinge pin must first be removed from the hinge or the edge portion of at least one of the hinge plates which at least partially wraps around the hinge pin must be stretched, broken or the like to enable its separation from the hinge pin. This is frequently an arduous and difficult operation, often as arduous and difficult as the reconstruction or reconstitution of the hinge subsequently when the same is desired. Thus the conventional physical hinge has hinge plates which are neither readily manually separable from one another nor readily manually joinable together (with the hinge pin), as desired.

3. The conventional mechanical hinge is by its nature neither monostable nor bistable—that is, it favors positioning of the hinge plates in neither the closed nor open orientations, as opposed to any of the intermediate orientations. While in many applications it is preferred that the hinge remain with the hinge plates in whatever orientation they were last left by the user, in other applications it is preferred that the hinge be biased to assume an open orientation, a closed orientation or either orientation. It is typically necessary for the conventional mechanical hinge to employ a biasing element (or gravity) acting on at least one of the hinge plates if the hinge is to be monostable, (i.e., biased to a preferred orientation) or bistable (i.e., biased to one of two preferred orientations as opposed to an intermediate orientation therebetween).

Accordingly, it is an object of the present invention to provide a magnetic hinge wherein in one preferred embodiment the hinge is characterized by a virtual hinge axis.

Another object is to provide such a magnetic hinge wherein in one preferred embodiment there is no physical hinge pin either to increase the physical dimensions of the hinge or to occupy space within the hinge plates.

A further object is to provide such a hinge wherein in one preferred embodiment the hinge plates are readily manually separable to deconstruct the hinge and readily manually joinable to reconstitute the hinge.

It is also an object of the present invention to provide such a hinge wherein in one preferred embodiment the hinge is bistable.

It is another object to provide various devices which may profitably incorporate such a hinge.

SUMMARY OF THE INVENTION

It has now been found that the above and related objects of the present invention are obtained in a magnetic hinge defining a hinge axis comprising a first hinge plate of non-magnetic material and a first magnet disposed in the first plate for movement therewith, as well as a second hinge plate of non-magnetic material and a second magnet disposed in the second plate for movement therewith. The first and second plates are generally juxtaposed and independently pivotable about the hinge axis between a closed orientation, wherein the first and second plates are essentially superposed, and an open orientation, wherein the first and second plates are essentially not superposed. The first and second magnets are generally juxtaposed and generally aligned with each other; they are essentially superposed and in the same magnetic orientation.

In a preferred embodiment, the first plate and the first magnet are readily manually separable from the second plate and the second magnet to deconstruct the hinge, and the first plate and the first magnet are readily manually joinable with the second plate and the second magnet to reconstitute the hinge.

In another preferred embodiment, the first and second plates are relatively pivotable about the hinge axis to a plurality of orientations intermediate the closed and open orientations. The hinge axis is stationary, and the hinge is devoid of a physical hinge pin extending through the first and second plates. The hinge axis is disposed inwardly of the peripheries of the first and second plates in both the closed and open orientations. The first and second magnets are preferably coaxial with the hinge axis.

Where the first and second magnets are cylindrical, the hinge is not bistable. Where the first and second magnets are non-cylindrical (e.g., rectangular in plan), the hinge is at least bistable. In both of the bistable orientations the first and second magnets are longitudinally aligned, essentially superposed, and in the same magnetic polar orientation, the first and second magnets being longitudinally realigned by 180°.

In a further preferred embodiment, the first and second magnets incorporate means to preclude movement of the first and second magnets transverse to the hinge axis while enabling independent pivotal movement of the first and second plates about the hinge axis. For example, one of the first and second magnets may project outwardly from the plane of its respective plate, and the other of the first and second magnets may be recessed inwardly within the plane of its respective plate. Alternatively, the first and second plates define a pair of adjacent facing surfaces incorporating cooperating means to preclude movement of the first and second plates transverse to the hinge axis while enabling independent pivotal movement of the first and second plates about the hinge axis. For example, one of the adjacent facing surfaces may define a pin projecting towards the other adjacent facing surface, and the other adjacent facing surface may define an arcuate recess receiving the pin therein and constraining the pin to movement along the recess during pivoting of the plates relative to one another.

The hinge may additionally include at least one third plate of non-magnetic material disposed at least partially intermediate the first and second plates and incorporating means cooperating with the movement-precluding means of the first and second magnets or the first and second plates for precluding non-pivotal movement of the at least one third plate relative to the hinge axis.

Where the plates are semi-cylindrical, the hinge axis is adjacent one end of the plates and remote from the other end of the plates. The hinge preferably additionally includes removable means for maintaining the plates in the closed orientation.

In one application of the hinge, a cosmetic case incorporates the hinge, the first plate defining a base of the case and the second plate defining a cover of the case, the base and cover being relatively pivotable about the hinge axis between the closed and open orientations.

The present invention also encompasses, in combination, a pair of the hinges and common means for maintaining the hinge axes of the pair of hinges in fixed spatial relationship, the first plates together in the closed orientation defining substantially a full cylinder, and the second plates together in the closed orientation defining substantially a full cylinder. The first and second plates of one hinge are separately and independently pivotable relative to both the common means and the first and second plates of the other hinge. The combination additionally includes removable means to preclude pivoting of the first and second plates.

The present invention further encompasses the aforesaid magnetic hinge including at least one third hinge plate of non-magnetic material disposed at least partially intermediate the first and second plates. The first, second and third plates are generally juxtaposed and independently pivotable about the hinge axis between a closed orientation, wherein the first, second and third plates are essentially superposed, and an open orientation, wherein at least one of the first, second and third plates is essentially not superposed with the others. The first and second magnets are essentially superposed and in the same magnetic orientation.

In a preferred embodiment, each of the first and second magnets projects outwardly from the plane of its respective plate towards the other of the magnets, and the third plate defines an aperture there through aligned with the hinge axis. Each of the first and second magnets has a projecting end in contact with the other magnet within the third plate aperture, and the third plate is pivotable about the hinge axis and the projecting ends of the first and second magnets.

The hinge is characterized by the absence of a third magnet.

In another preferred embodiment, the first and second magnets incorporate means to preclude movement of the first and second magnets transverse to the hinge axis while enabling independent pivotal movement of the first, second and third plates about the hinge axis. More particularly, the third plate incorporates means to preclude movement of the first and second magnets or the first and second plates transverse to the hinge axis while enabling pivotal movement of the first, second and third plates about the hinge axis.

The present invention also encompasses, in combination, a pair of the hinges and common means for maintaining the hinge axes of the pair of hinges in fixed spatial relationship, the first plates together in the closed orientation defining substantially a full cylinder, the second plates together in the closed orientation defining substantially a full cylinder, and the third plates together in the closed orientation defining substantially a full cylinder.

Preferably, the first, second and third plates of one hinge are separately and independently pivotable relative to both the common means and the first, second and third plates of the other hinge. The common means may comprise a common base and a pair of pins projecting upwardly from the common base in fixed spatial relationship, each pin spatially fixing the hinge axis of a respective one of the hinges. The pins are either in close side-by-side juxtaposition or, preferably, at opposed ends of the common base.

The combination may additionally include removable means (e.g., a removable cover) to preclude pivoting of the first, second and third plates.

BRIEF DESCRIPTION OF THE DRAWING

The above and related objections, features and advantages of the present invention will be more fully understood by reference to the following detailed description of the presently preferred, albeit illustrative, embodiments of the present invention when taken in conjunction with the accompanying drawing wherein:

FIG. 6 is a top plan view thereof with a portion of the transparent cover cut away to reveal details of internal construction;

FIG. 7 is a side elevational view thereof with portions broken away to reveal details of internal construction and with the transparent cover also illustrated in phantom line separated from the remainder of the hinge;

FIG. 13 is an isometric view of a bistable third embodiment of the present invention;

FIG. 14 is a fragmentary sectional view thereof taken along the line 14—14 of FIG. 13;

FIG. 15 is a top plan view of the third embodiment with the plates in the open orientation;

FIG. 16 is a fragmentary sectional view thereof taken along the line 16—16 of FIG. 15;

FIG. 17 is a top plan view of a variant of the first embodiment, with the bottom plate being illustrated in phantom line in an open orientation; and FIG. 18 is a fragmentary sectional view thereof taken along the line 18—18 of FIG. 17.

DETAILED DESCRIPTION OF THE PREFERRED EMBODIMENTS

Figure 1:
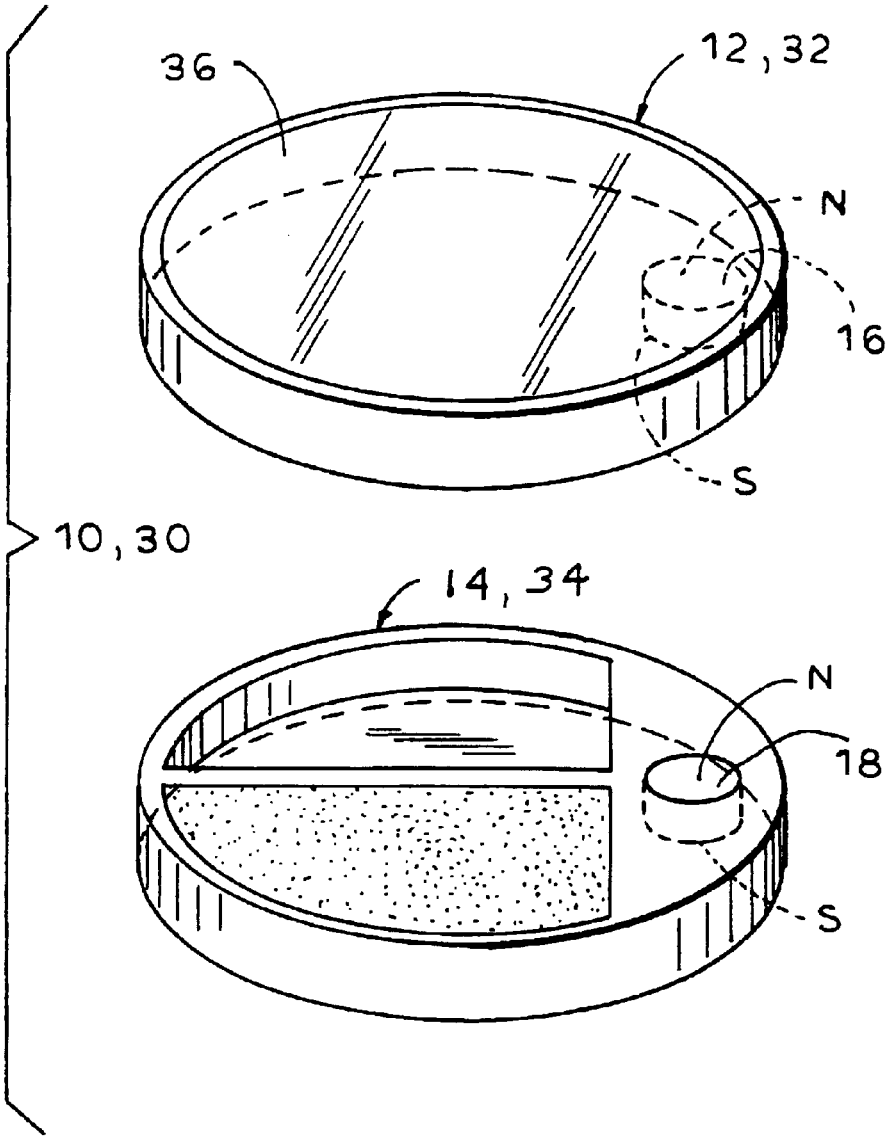
FIG. 1 is an isometric view of a first embodiment of the present invention with the plates in a separated state.
Figure 4:
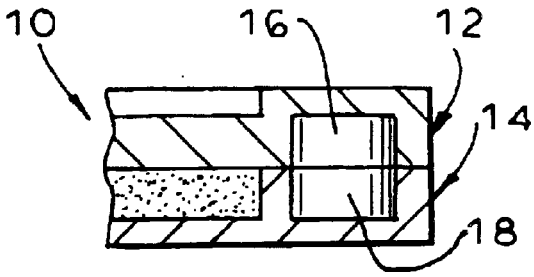
FIG. 4 is a fragmentary sectional view taken along the line 4—4 of FIG. 3.

Consonant with the description of a conventional mechanical hinge as consisting of hinge plates and a hinge pin pivotally connecting the hinge plates, the following description employs the term "hinge plate" or "plate." However, it should be appreciated that, as in the conventional physical hinge, the "plate" need not be flat or thin (as might be suggested by use of the term "plate"), but may alternatively be possessed of an uneven non-flat surface and a thick or irregular non-thin configuration.

Referring now to the drawing, and in particular to FIGS. 1–4 thereof, therein illustrated is a first embodiment of a hinge according to the present invention, generally designated by the reference numeral 10.

The hinge 10 comprises a first hinge plate, generally designated 12, and a second hinge plate, generally designated 14, both plates being of non-magnetic material and disposed in generally juxtaposed relationship, preferably in parallel planes. At least one first bipolar magnet 16 is disposed in the first plate 12 for movement therewith, and at least one second bipolar magnet 18 is disposed in the second plate 14 for movement therewith. Preferably, as illustrated, the first and second magnets 16, 18 and the first and second plates 12, 14, are generally cylindrical with opposite circular faces of each magnet being of opposite magnetic polarity.

Figure 2:
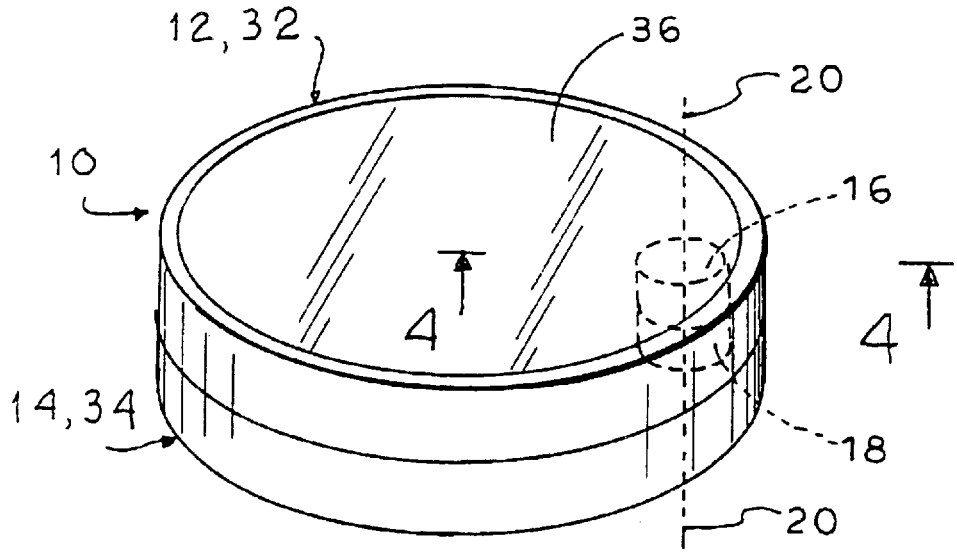
FIG. 2 is an isometric view thereof in a joined state and in the closed orientation.
Figure 3:
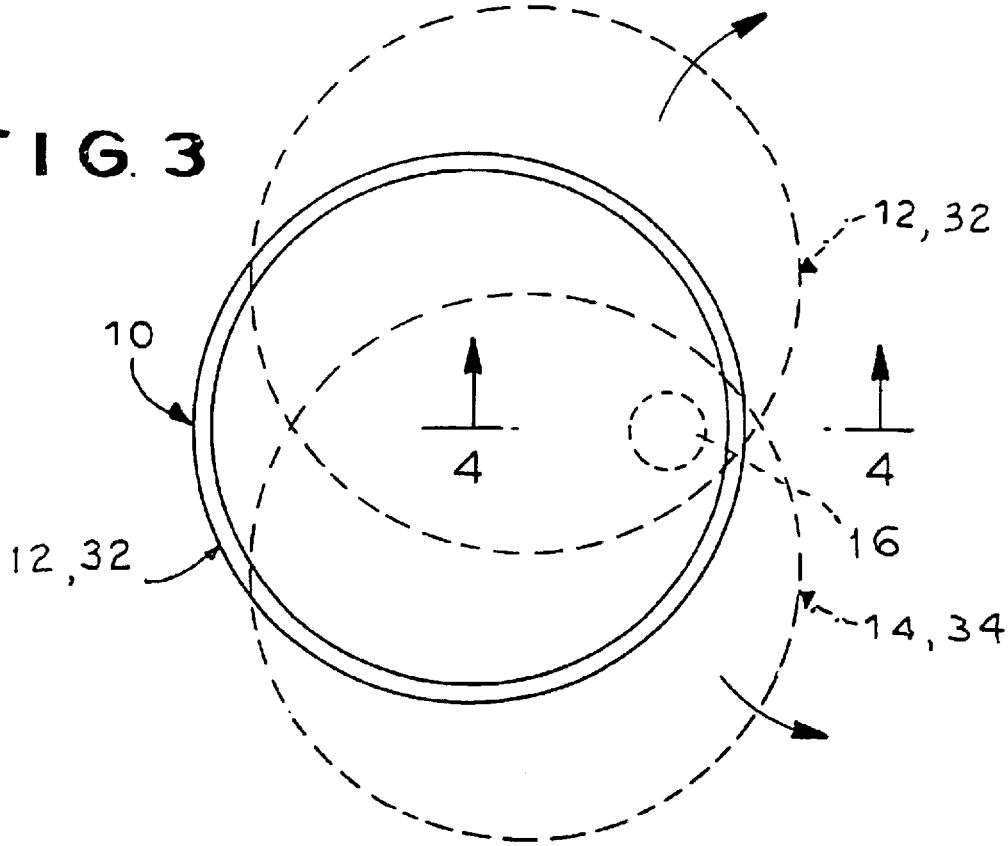
FIG. 3 is a top plan view thereof of with the hinge being shown in a solid line in a closed orientation and in broken line in an open orientation.

The first and second plates 12, 14 are in generally parallel planes, but pivotable about the hinge axis 20 between the closed orientation illustrated in FIG. 2 and in solid line in FIG. 3 and the open orientation illustrated in phantom line in FIG. 3. In the closed orientation the first and second plates 12, 14 are substantially overlapping and preferably essentially superposed, while in the open orientation they are substantially non-overlapping and preferably not essentially superposed. (The term "superposed" is used to mean in complete vertical alignment and not just partially overlapping.) The first and second magnets 16, 18 are generally vertically aligned with each other and coaxially aligned with the hinge axis 20, and in the same magnetic orientation, either

| | | |
|---|---|---|
| N | | S |
| S | or | N |
| N | | S |
| S | | N |

In both the open and closed orientations, the magnets 16, 18 are in a face-to-face orientation, substantially overlapping, and preferably essentially superposed. Preferably, the adjacent faces of the magnets 16, 18 are substantially flush with the adjacent facing surfaces of the plates 12, 14 in which they are disposed and optimally in immediate physical contact with each other.

As illustrated in FIG. 1 in particular, the first plate 12 and the first magnet 16 are readily manually separable from the second plate 14 and the second magnet 18 (in either the open or closed orientation)to deconstruct the hinge 10. Thus, each plate 12, 14 may be removed from the vicinity of the other plate 14, 12 for separate use. As illustrated in FIG. 2 in particular, the first plate 12 and the first magnet 16 are readily manually joinable with the second plate 14 and the second magnet 18 to reconstitute or reconstruct the hinge 10 in either the closed or open orientation.

Because the hinge pin is only virtual and not physical, the virtual hinge axis 20 does not increase the physical dimensions of the hinge 10 and the virtual hinge axis 20 does not physically occupy space immediate the hinge plates 12, 14. As the hinge axis 20 neither increases the physical dimensions of the hinge nor physically occupies space intermediate the hinge plates, the hinge can be extremely compact and allow maximum utilization of the space intermediate the plates.

The magnets 16, 18 are preferably of small size but significant magnetic strength and may be formed of alnico, neodymium (a rare-earth metal) or like materials of high magnetic flux. Preferably the magnets 16, 18 are of sufficient magnetic strength that, in the absence of an intentional effort to separate the plates 12, 14, they maintain themselves coaxial with hinge axis 20 extending there through. That is, the magnets are sufficiently strong to preclude movement thereof transverse to the hinge axis 20, while still enabling independent rotation thereof (and thus rotation of the first and second plates 12, 14) about the hinge axis 20.

If desired, the first and second magnets 16, 18 may incorporate means cooperatively precluding movement thereof transverse to the hinge axis 20, while still enabling independent pivotable movement of the first and second plates 12, 14 about the hinge axis 20. To this end, one magnet 16, 18 may project slightly from the inwardly facing surface of its respective plate 12, 14 (rather than being flush therewith), and the other magnet 18, 16 may be slightly recessed from the inwardly facing surface of its respective plate 14, 12 (rather than being flush therewith). Thus the projecting portion of the first-mentioned magnet may extend into and be received in the recess associated with the second-mentioned magnet. In this projection/recess system the two magnets 16, 18 cooperatively act as a single hinge pin to preclude transverse movement of the plates 12, 14 relative to the hinge axis 20. If projecting magnet 16 is of sufficient magnetic strength, recessed magnet 18 may be replaced by a simple metal plate attracted by magnet 16.

Optimally, the magnets 16, 18 maintain the adjacent facing surfaces of the plates 12, 14 in such close frictional contact that the plates 12, 14 will remain in the closed orientation unless and until intentionally manually moved to the open orientation. Where the friction between the adjacent facing surfaces of the plates 12, 14 is not adequate for maintaining the plates 12, 14 in the closed orientation under normal conditions of storage (for example, in a ladies handbag), releasable cover means may be provided for maintaining the plates 12, 14 in the closed orientation. For example, a removable transparent cover open at one end and having substantially the same configuration and dimensions as the outer surface of the plates may be provided. It may also be desirable to provide a releasable cover for protection of the outwardly facing opposed surfaces of the plates 12, 14 or their contents (e.g., where they contain mirrors).

While the plates 12, 14 have been shown and described as being cylindrical (that is, circular in plan) or semi-cylindrical, alternatively they may be formed of other configurations, for example, polygons, or the like. Where the plates are semi-cylindrical, the hinge axis 20 is preferably adjacent one end of the plates and remote from the other end of the plates. Where the plates are polygonal, preferably the hinge axis is closely adjacent one angle of the polygonal outline and remote from the other angles.

Referring now to FIGS. 17–18, therein illustrated is a variant hinge 10A wherein the plates 12A, 14A incorporate means cooperatively precluding movement thereof transverse to hinge axis 20, while still allowing pivotal movement thereabout. In such a variant 10A one of the plates 14A, 12A defines a preferably circular projection 80 spaced from the hinge axis 20 and closely about its magnet 18, 16, while the opposite plate 12A, 14A defines an arcuate or circular recess 82 coaxial with the hinge axis 20 and closely about its magnet 16,18. The recess 82 is configured and dimensioned to receive therein the projection 80, while still allowing for independent rotation of the plates about the hinge axis 20. Thus, the bottom face of the first or upper plate 12A may have a downwardly opening arcuate groove or recess 82, while the top face of the second or lower plate 14A may have an upwardly extending projection 80, or vice versa. The projection 80 is received within the groove or recess 82, regardless of whether the plates are in the open or closed orientation. This construction precludes sliding movement of the plates transverse to the hinge axis 20. It will be appreciated, however, that the use of a projection/recess system in the plates 12A, 14A increases the effective diameter of the hinge axis 20 more than when the projection/recess system is in the magnets 16, 18 only. Of course, if desired, both projection/recess systems may be employed concurrently.

The hinge 10 of the present invention may be incorporated in a wide variety of different consumer and industrial products. By way of example, the hinge 10 is illustrated in the context of a modular hinge compact or cosmetic case, generally designated 30. One of the plates (here, upper plate 12) defines a cover 32 of the case 30, and the other of the plates (here, lower plate 14) defines a base 34 of the case 30, the base 34 and cover 32 being movable between closed and open orientations, as illustrated. Optionally, as illustrated, the cover 32 includes in a recess on its top surface a mirror 36, and the base 34 includes in an open-top compartment thereof a cosmetic 38 (such as a powder, base, lipstick, eyeshadow or the like) which may be applied while looking into the mirror 36 or "checked" thereafter by looking into the mirror 36. Alternatively, or in addition thereto, an appropriate recess 42 may be provided in the base 34 for storage of a cosmetic applicator (such as a powder brush, eyeliner pencil, lipstick brush or the like). The mirror 36 is preferably slightly recessed in the cover 32 for protection against scratching.

Because the cover 32 and base 34 of the compact 30 (i.e., first plate 12 and second plate 14 of hinge 10) may be manually readily separated from one another, as illustrated in FIG. 1, the separated mirror-containing cover 32 may conveniently be leaned against a separate support ease of viewing while the user holds the base 34 and applies the cosmetic 38 therefrom.

Conveniently, the cosmetic 38 may be disposed in a removable pan (not shown) which is insertable into and removable from the base 34 with the cosmetic 38 therein as a unit. Of course, the pan may be divided to hold more than one cosmetic 38, and, indeed, the base 34 may be configured to hold a plurality of smaller pans rather than a single large pan. Where the pans are releasably maintained in base 34, they are easily replaceable to allow interchanging of different colored eye shadow, face powder or lipstick combinations.

A preferred cylindrical compact case 30 according to the present invention may have a plate diameter as small as 2", a magnet diameter as small as ¼", and a thickness or depth as small as ½". No internal volume of the compact is wasted on a physical hinge pin.

Referring now to FIGS. 5–10, therein illustrated is a second embodiment of a hinge according to the present invention, generally designated 10'. Components of the second embodiment hinge 10' having a similar structure or function to components of the first embodiment hinge 10 will be designated by the same reference numeral.

In the second embodiment, the hinge 10' utilizes plates 12', 14' that are substantially semi-cylindrical rather than cylindrical. Two of the semi-cylindrical hinges 10' are used in combination, side-by-side, in a given compact case 30' so that the overall appearance of compact 30' is generally similar to that of compact 30 using a single hinge 10. The compact 30' provides additional compartments for the compact 30' by adding to each hinge 10' a third or intermediate plate, generally designated 50, disposed between the first and second plates 12', 14'. The presence of the third plate 50 typically increases the thickness of the compact 30 by less than one-half. As the contents of the third plate 50 are generally better protected then the upper surface of the first plate, in the compact 30' the mirror 36 is typically relocated to lie in a recess on the upper surface of the third plate 50.

Figure 9:
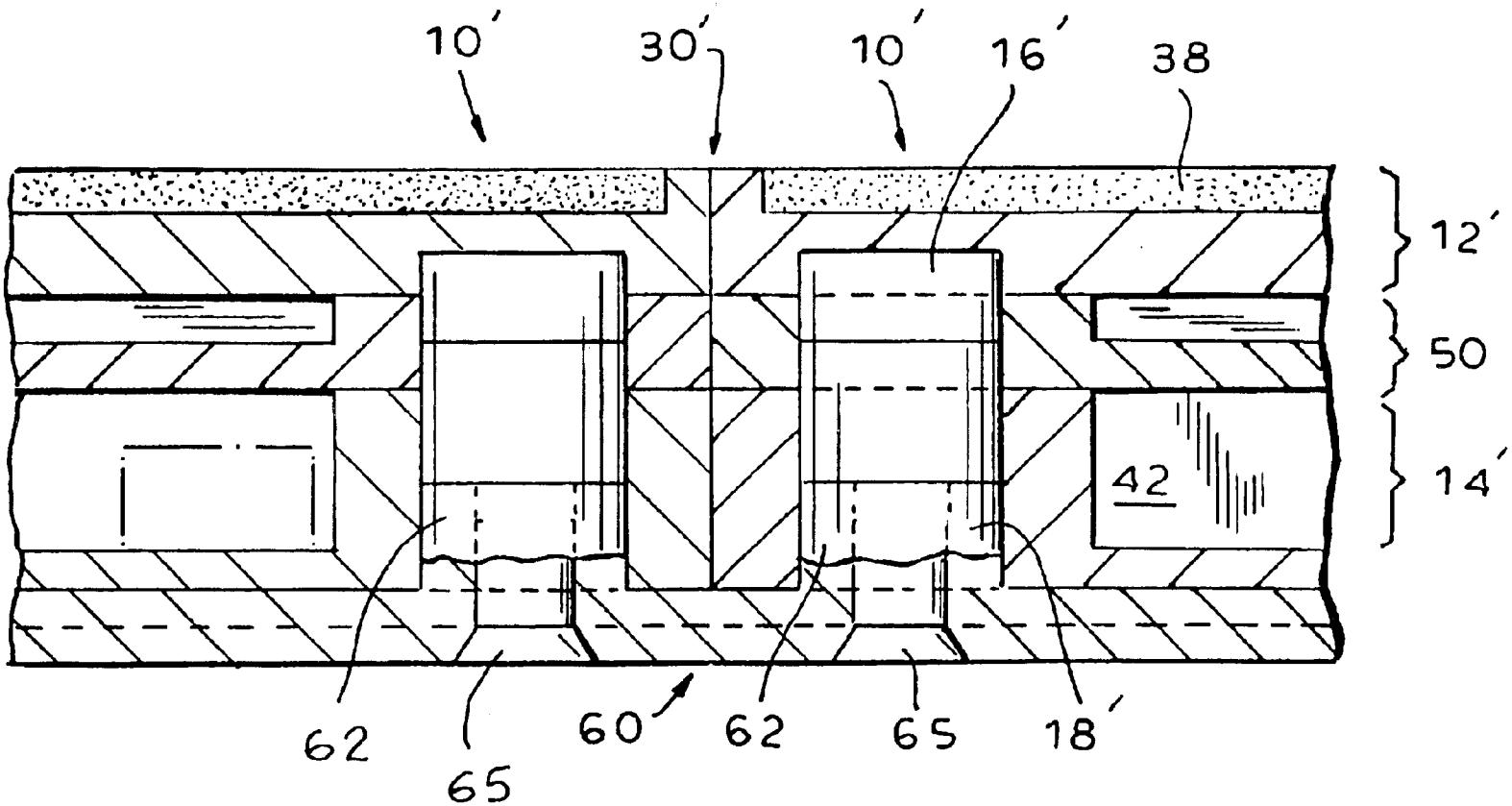
FIG. 9 is a fragmentary sectional view taken along the line 9—9 of FIG. 6.
Figure 10:
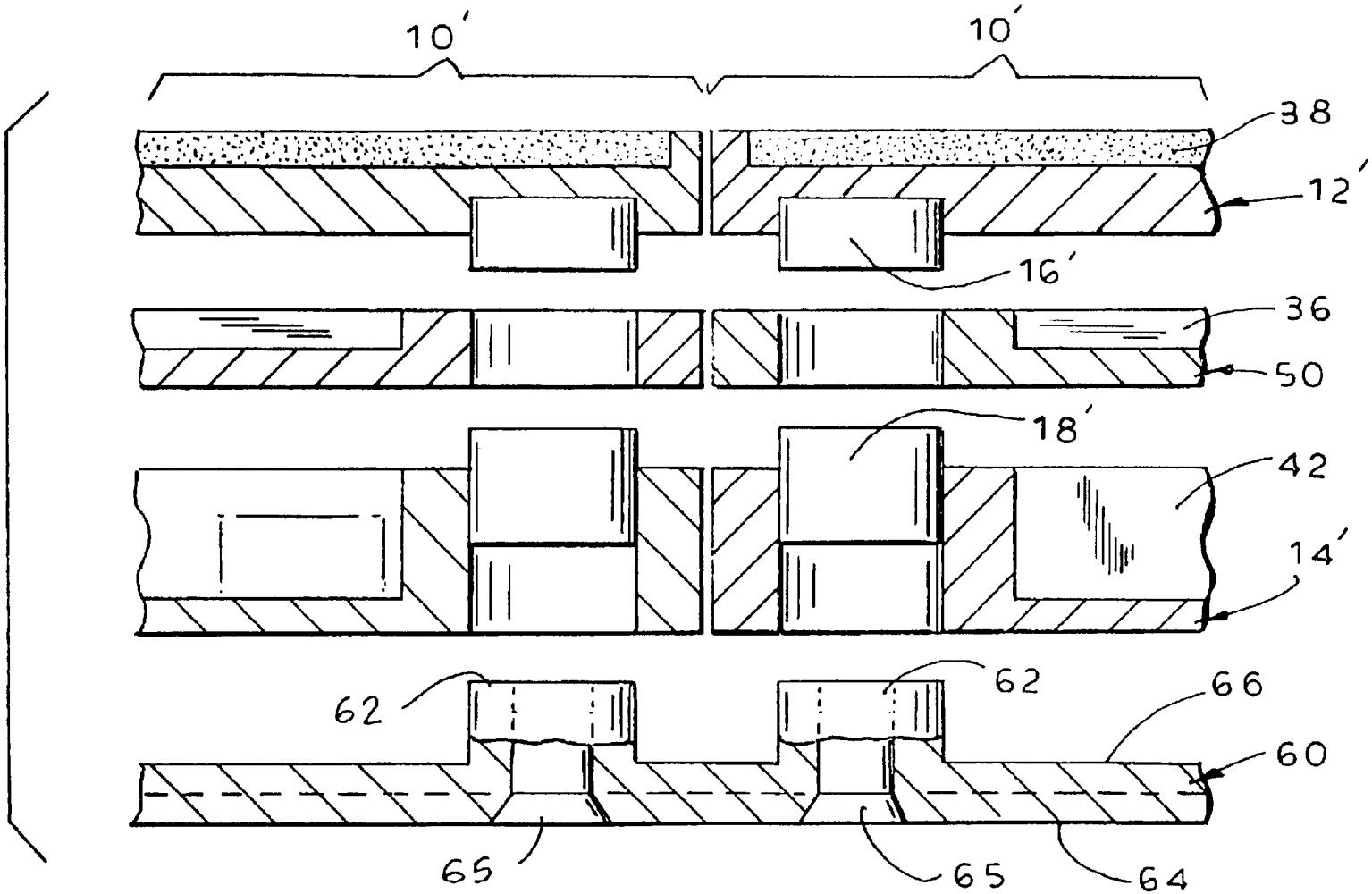
FIG. 10 is an exploded fragmentary sectional view of the hinge shown in FIG. 9.

The third plate 50 does not have a magnet disposed therein for movement therewith. Rather the third plate 50 defines an open-ended chamber or compartment 52 therethrough vertically aligned with magnets 16', 18' and coaxial with the hinge axis 20. Unlike the magnets 16, 18 in the respective plates 12, 14 of the first embodiment hinge 10, the magnets 16', 18' of the second embodiment hinge 10' are not flush with the facing surfaces of the plates 12', 14', but rather project from such surfaces (downwardly in the case of magnet 16' associated with the first or upper plate 12', and upwardly in the case of magnet 18' associated with the second or lower plate 14'). Thus, as best seen in FIGS. 7 and 9–10, projecting free ends of magnets 16', 18' each enter into the chamber 52 of third plate 50 from opposite directions. The projecting ends of magnets 16', 18' are preferably closely adjacent, and optimally in contact, within compartment 52, but may be slightly spaced apart. When they are in contact, the combined magnets 16', 18' act physically as a single hinge pin coaxial with hinge axis 20.

Figure 8:
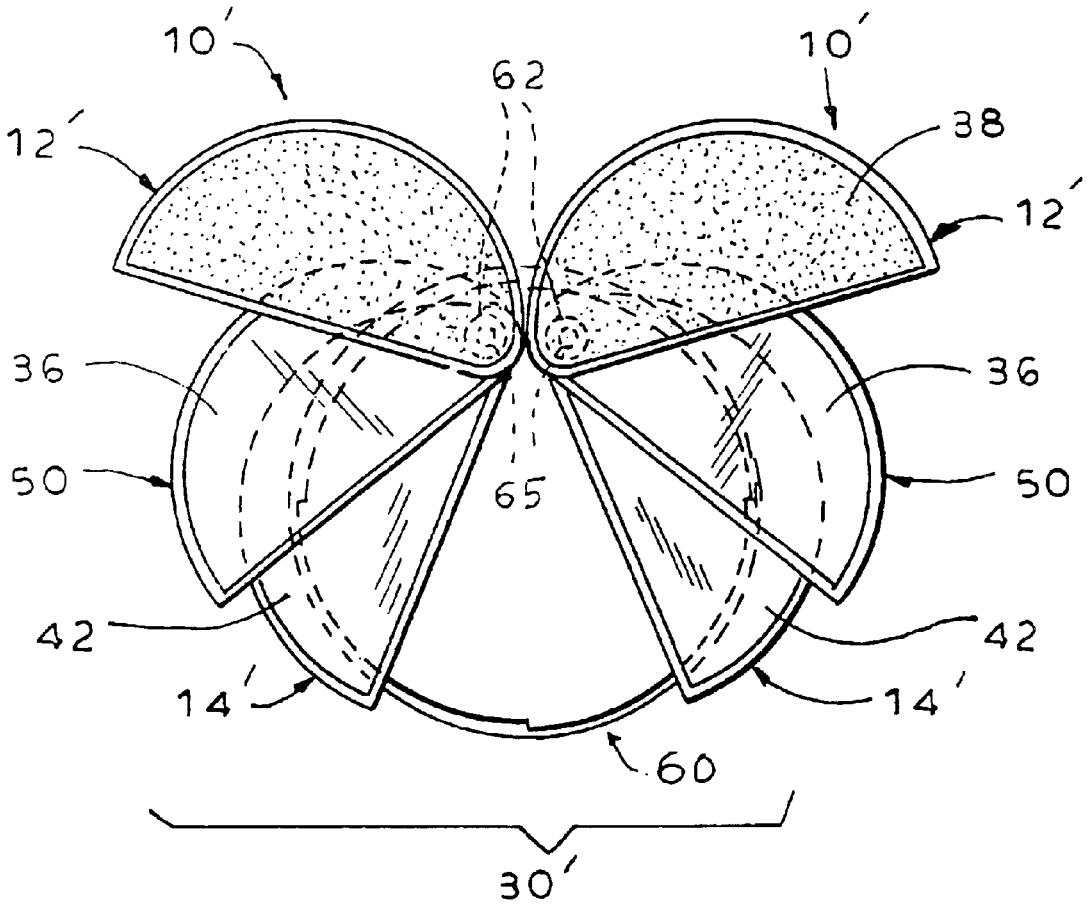
FIG. 8 is a top plan view thereof (without the transparent cover) with the plates being illustrated in an open orientation.

Referring now to FIG. 8 in particular, just as the first and second plates 12', 14' are separately and independently pivotable relative to one another about the hinge axis 20, the third plate 50 may be independently pivoted relative to the first plate 12', the second plate 14', or both, about hinge axis 20.

Just as the first and second plates 12', 14' may be separated from each other, the third plate 50 may be separated from the first and second plates 12', 14' by manually separating the plates 12', 14' until the projecting ends of magnets 16', 18' leave compartment 52. The entire hinge 10' (including third plate 50) may subsequently be reconstituted.

Just as the first and second plates 12', 14' are non-stable, the third plate 50 is non-stable-that is, it is not stable in either of the closed or open orientations.

The compact 30' is further provided with a circular base, generally designated 60, including two juxtaposed upstanding lugs or pins 62. The base 60 is formed of non-magnetic material, and is preferably formed of plastic. The pins 62 are configured and dimensioned to be snugly received within the hollowed out portions of the second plates 14' below the magnets 18', while still allowing free pivotal movement of the plates 14' about the axis 20 of each hinge 10' and separation of the second plate 14' from the base 60. The lateral juxtaposition of the two pins 62 laterally juxtaposes the two hinges 10'.

In the preferred embodiment illustrated, metal members 65 extend through the upstanding pins 62, the upper surfaces of member 65 and pins 62 preferably being coplanar. The metal members may be in the form of rivets to reinforce the upstanding pins 62 in their relative positions on the base 60. Where the metal member 65 is either magnetic or magnetizable (by close proximity to the magnets 18'), they serve the additional function of assisting in maintenance of the hinges 10' on the base 60 by providing a magnetic connection between the hinges 10' and the base pins 62, thereby preventing an accidental separation of the hinges 10' from the base 60 should the compact 30' be accidentally jarred.

In addition to the relatively planar circular bottom 64, the base 60 includes immediately above the bottom 64 a locking member 66 preferably defining a plurality (here, four) spiral shaped segments 68. Each segment 68 gradually increases in diameter from one end to the other and thus approaches the diameter of the bottom 64, although stopping short thereof.

In addition to the base 60, the compact 30' additionally includes a removable cover, generally designated 70. The cover 70 is illustrated only in FIGS. 5–7, and for ease of illustration not in FIGS. 8–10. The removable cover 70 is formed of non-magnetic material and is preferably formed of a transparent plastic so that the cosmetics 38 in the first plates 12' are visible through the transparent tops 72 of cover 70. When the cover 70 is in place, the depending sidewall 74 of cover 70 extends down to the top of the bottom 64 of base 60. While the cover 70 is in place, on base 60, the sidewall 74 thereof maintains the two hinges 10' in their closed orientation; removal of the cover 70 from the base 60 allows the free and independent pivoting of the plates 12', 50, 14' of each hinge 10' about a respective hinge axis 20, each plate 14' also being pivotable about the pin 62 therein.

The cover sidewall 74 preferably defines a plurality (here, four) spiral segments 78 corresponding to the segments 68 of base 60. But while base segments 68 extend outwardly toward the periphery of base 60, the cover segments 78 extend inwardly from the periphery of sidewall 74 and are configured and dimensioned so that, when the segments 68, 78 are in the same horizontal plane, appropriate rotation of the base 60 and cover 70 effects a compression fit of the cover 70 and base 60. The compression fit maintains the cover 70 on the base 60 until counter-rotation of the base 60 and cover 70 releases the compression fit.

Figure 5:
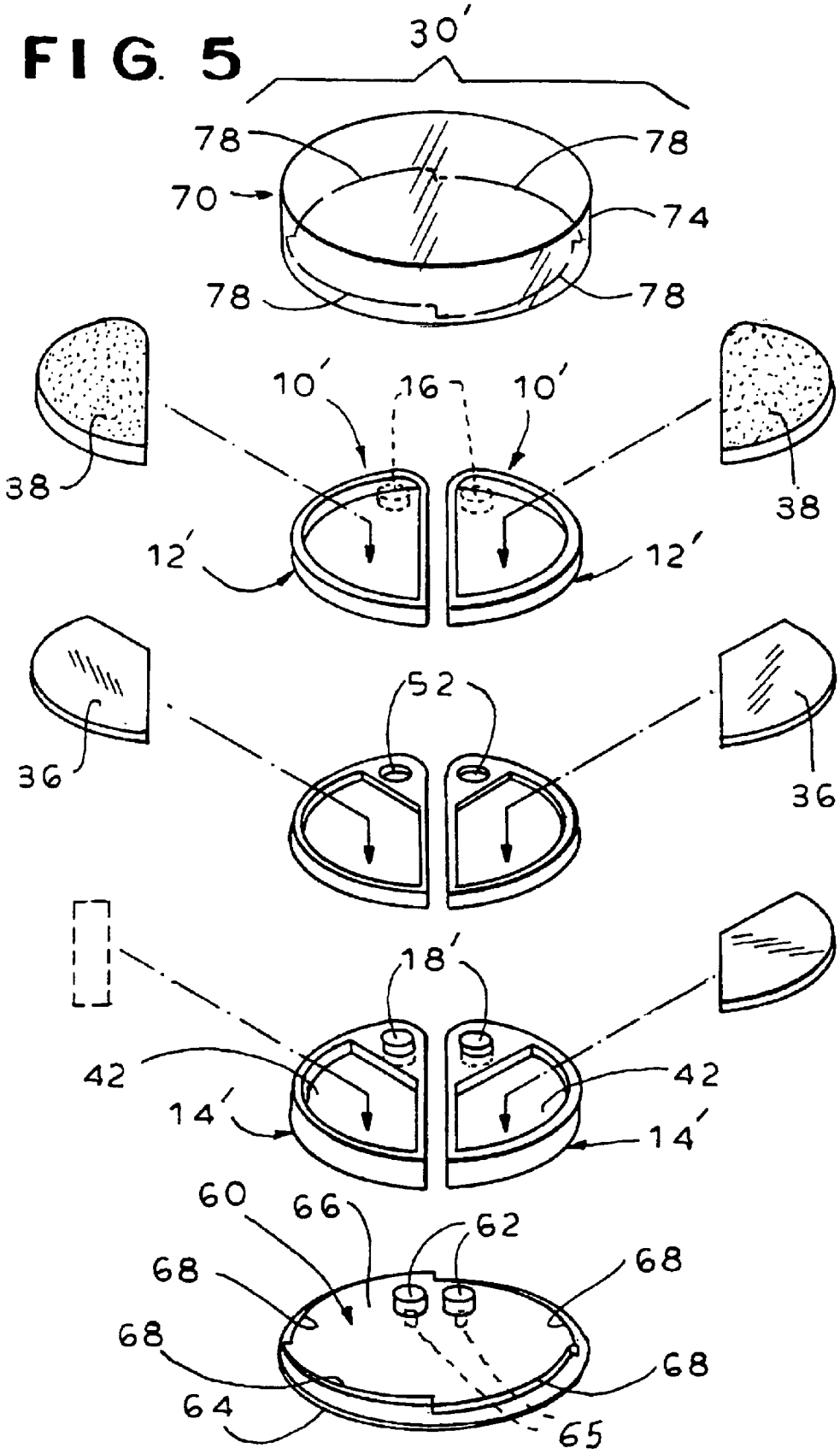
FIG. 5 is an exploded isometric view of a second embodiment of the present invention.

It will be appreciated that the outward pivoting of the various plates 12', 50, 14' about the hinge axis 20 of the respective hinge 10' is limited, as illustrated in FIG. 8, by the abutments of the several plates of one hinge 10' against the corresponding plates of the other hinge 10'. Indeed, in order to achieve even the amount of free pivotal movement illustrated in FIG. 8, the corners of the semi-cylindrical plates adjacent the hinge axis 20 must be somewhat curved. This degree of curvature can be used to limit the outward pivoting of the plates to a desired level. Thus, careful design of the laterally adjacent surfaces of the two hinges 10' in the second embodiment of the present invention, as illustrated in FIGS. 5–10, is critical to avoid undue limitation of the free pivotal movement of the plates 12', 50, 14' of one hinge 10' relative to the corresponding plates 12', 50, 14', respectively, of the other hinge 10'. And even with careful design, some limitation on the free pivotal movement of the plates of one hinge 10' relative to the plates of the other hinge 10' of the compact 30' will typically still exist. Furthermore, the side-by-side close juxtaposition of the upstanding pins 62 on the circular base 60 of compact 30' mandates, as best seen in FIG. 5, that each of the two plates 12', each of the two plates 50 and each of the two plates 14' of the two hinges 10' be manufactured separately (because of their separate configurations) as six separate and distinct components, thereby increasing tooling and molding costs for the compact 30'.

Figure 11:
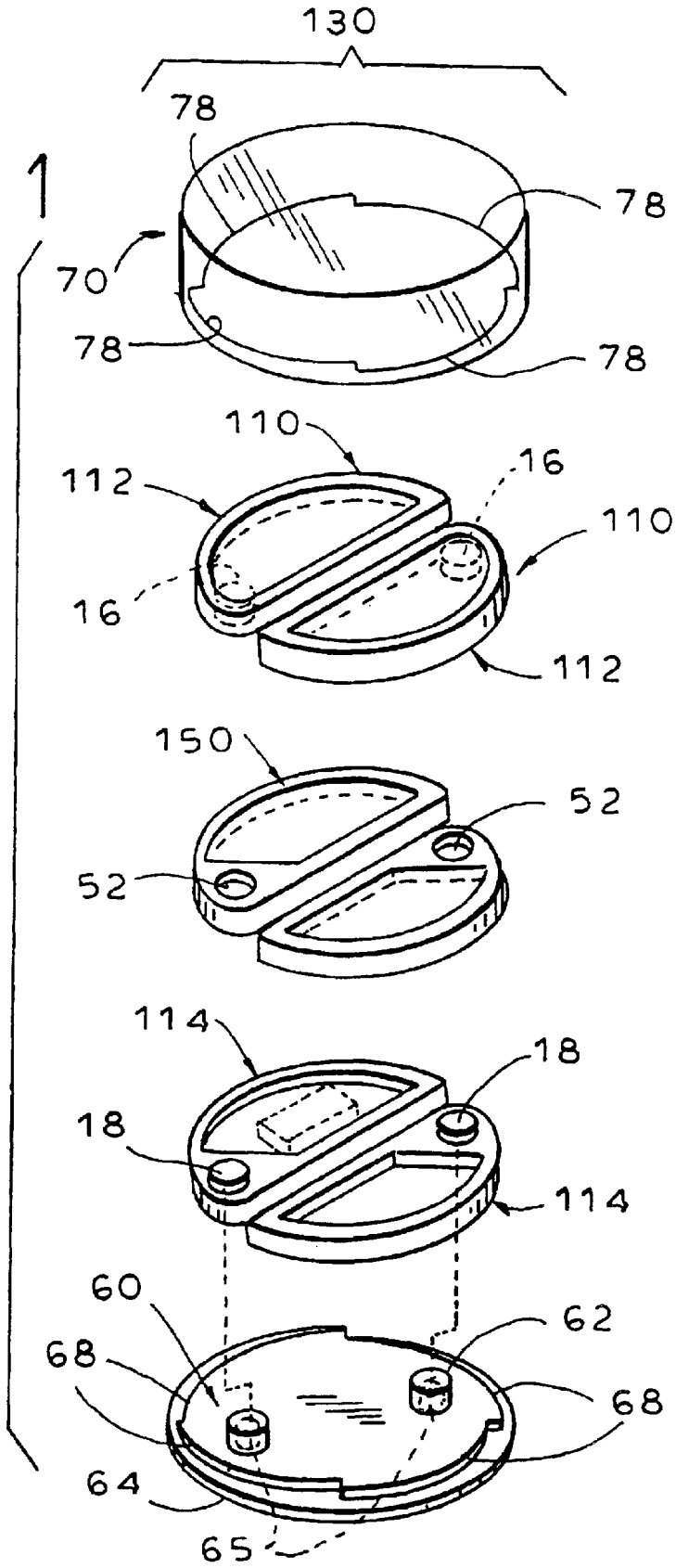
FIG. 11 is an exploded isometric view of a variant of the second embodiment.
Figure 12:
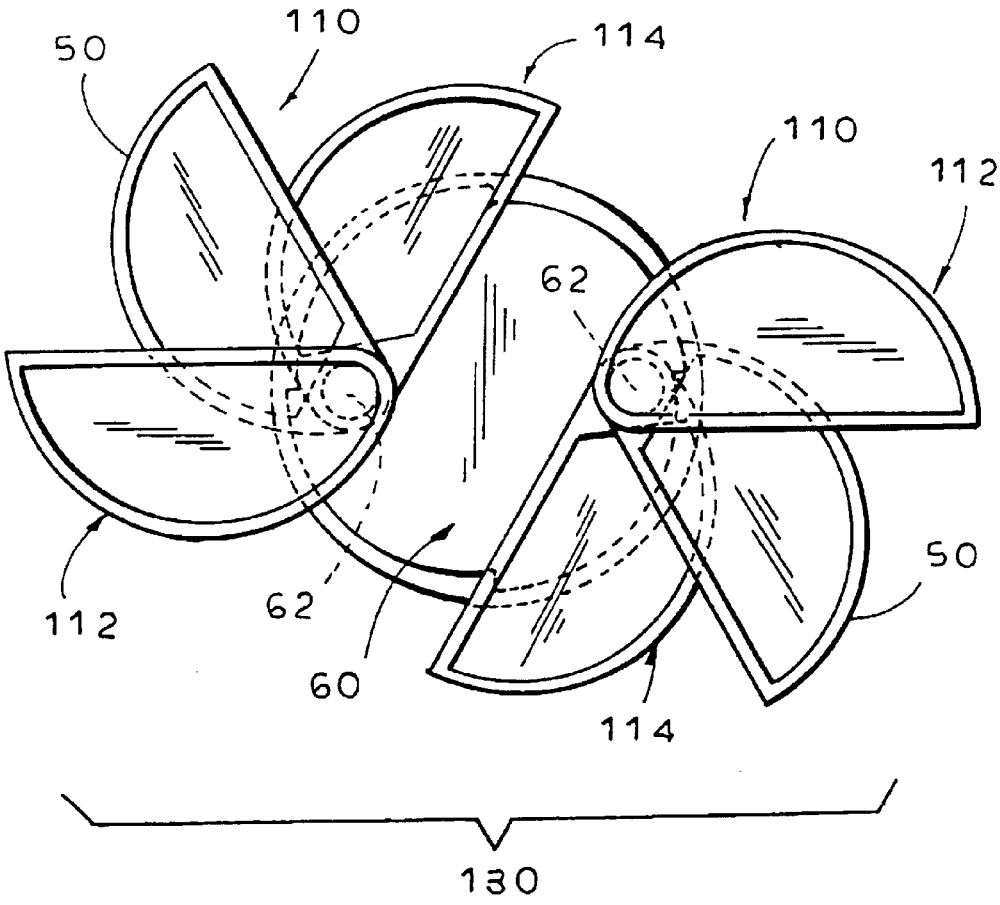
FIG. 12 is a top plan view of the variant (without the transparent cover) with the plates being illustrated in an open orientation.

Accordingly, referring now to FIGS. 11–12 in particular, therein illustrated is a variant of the second embodiment compact 30', the variant being generally designated 130. In the variant compact 130 the upstanding pins 62 of base 60 are not disposed in close side-by-side juxtaposition (as seen in FIG. 5), but rather are widely spaced from one another, preferably essentially at opposite ends of a diameter of the circular base 60 (as illustrated in FIG. 11). As a result of this seemingly inconsequential change in the relative disposition of the upstanding pins 62, in the variant compact 130 both plates 112 of the two hinges 110 are identical, as are the two plates 150 and the two plates 114. Accordingly, since only three plate elements 112, 150 and 114 need be molded, the tooling and molding costs of the variant compact 130 are greatly reduced relative to the second embodiment compact 30'. In addition to this significant advantage to the manufacturer of the variant compact 130, the user of the variant compact 130 benefits as well since, as illustrated in FIG. 12, the two plates of the two variant hinges 110 barely interact with one another during intended operation of the compact 130.

The first embodiment 10 and the second embodiment 10 are essentially non-stable. In other words, the relative orientations of the plates 12, 14 of the first embodiment hinge 10 about the hinge axis 20 may vary freely, and the relative orientations of the various plates 12', 50, 14' of the second embodiment 30' may vary freely. In other words, there exists no preferred or stable orientation of the plates about the hinge axis 20 due to the intrinsic nature of the hinge 10, 10'. Thus, in the first embodiment 10 any restriction of the free pivotal movement of a plate 12, 14 relative to the hinge axis 20 results either from friction or the presence of a cover 70. In the second embodiment 10' any such restriction results from friction, the presence of a cover 70 maintaining the facing linear surfaces of the corresponding plates of the two hinges 10' in abutment, or from the juxtaposition of the two hinges 10' such that the plates of one hinge limit free pivotal movement of the corresponding plates of the other hinge.

It is contemplated that some users of a cosmetic case according to the present invention will prefer such freely rotating plates and the absence of any preferred or stable orientations thereof. However, it is also contemplated that many users would prefer a cosmetic case in which the intrinsic nature of the hinges provided the plates with two stable or self-maintaining orientations: one in which the plates were in the original or closed orientation (see FIGS. 1 and 2 for the first embodiment 30 and FIGS. 5–7 for the second embodiment 30) and one in which the plates were in an open orientation.

Referring now to FIGS. 13–16, therein illustrated is a bistable third embodiment, generally designated 210 and exemplified in the context of the first embodiment hinge 10. The cylindrical or button magnets 16, 18 in the plates 12, 14 of the first embodiment hinge 10 are replaced by rectangular parallelopiped magnets 216, 218 in the plates 212, 214. It will be appreciated that the rectangular parallelopiped magnets 216, 218 are not "bar magnets" wherein the opposite poles are disposed along the longitudinal axis of the magnet, but rather akin to the aforementioned cylindrical or button magnets 16, 18 in that the polarities are defined by the upper and lower major faces of the magnets 216, 218.

The magnets 216, 218 are secured to the plates 212, 214, respectively, for movement therewith. In the closed orientation of FIGS. 13–14, the plates 212, 214 are substantially overlapping and preferably essentially superposed, as are longitudinally aligned magnets 216, 218. The magnets are in the same magnetic orientation, with the south pole (S) of one magnet 216, 218 vertically adjacent to the north pole (N) of the other magnet 218, 216. In the open orientation of FIGS. 15–16, the plates 212, 214 are reoriented such that they are at most only slightly overlapping (that is, at most only minimally superposed), and the magnets 216, 218 remain longitudinally aligned, substantially overlapping and preferably essentially superposed, but one of the magnets 216, 218 has been longitudinally inverted—that is, its longitudinal axis has been reversed or reoriented by 180°. The magnets 216, 218 remain in the same magnetic orientation as in the closed orientation.

The plates 212, 214 are easily manually manipulated, by pivoting one or both about the common hinge axis 20, between open and closed orientations, the magnets 216, 218 remaining essentially superposed and longitudinally aligned in both the open and closed orientations, although the relative longitudinal alignment is 180° reversed.

The attraction of the magnets 216, 218 is preferably sufficiently strong to maintain the plates 212, 214 in a predetermined stable relative orientation (whether open or closed), notwithstanding minor incidental vibrations (e.g., minor shaking of a user's hand while holding the compact). It is not necessary for the user to exactly superpose the plates 212, 214 in the closed orientation or to exactly place them in the open orientation; placement of the plates, 212, 214 generally in one or the other relationship will result in the magnetic forces completing the task of moving the plates to the fully closed or fully open orientation once free relative rotation of the plates is enabled (e.g., by the removal of manual restrictions).

The bistable third embodiment 210 having been expounded herein above with respect to the first embodiment hinge 10, it will be apparent that the same technique may be applied to the variant 10A thereof to obtain bistability, provided that the recess 82 is of sufficient length to accommodate the projection 80 in both stable orientations of the variant 10A. Similarly, the second embodiment hinge 30 and the variant 130 thereof may be made bistable using the same technique (preferably using magnets which are not just rectangular, but square in plan), provided that the compartment 52 in each intermediate plate 50, 150 is of sufficient diameter to allow for an 180° pivoting of any magnet extending thereinto.

To summarize, the current invention provides a magnetic hinge characterized in one embodiment by a virtual hinge axis. The hinge has no hinge pin either to increase the physical dimensions of the hinge or occupy space at the immediate hinge plates. The hinge plates are readily manually separable to deconstruct the hinge and readily manually joinable to reconstitute the hinge. Various devices may profitably incorporate such a hinge.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A cosmetic case having a magnetic hinge defining a hinge axis, comprising:

(A) as a base of said case, a first hinge plate of non-magnetic material;

(B) a first magnet disposed in said first plate for movement therewith;

(C) as a cover of said case, a second hinge plate of non-magnetic material; and (D) a second magnet disposed in said second plate for movement therewith;

said first and second plates being generally juxtaposed and independently pivotable about the hinge axis in respective parallel planes transverse to the hinge axis between:

(i) a closed orientation wherein said first and second plates are essentially superposed, and (ii) an open orientation wherein said first and second plates are essentially not superposed;

said first and second magnets being essentially superposed and in the same magnetic orientation.

2. The cosmetic case of claim 1 wherein said first plate and said first magnet are readily manually separable from said second plate and said second magnet to deconstruct said hinge.

3. The cosmetic case of claim 2 wherein said first plate and said first magnet are readily manually joinable with said second plate and said second magnet to reconstitute said hinge.

4. The cosmetic case of claim 1 wherein said first and second plates are relatively pivotable about the hinge axis to a plurality of orientations intermediate said closed and open orientations.

5. The cosmetic case of claim 1 wherein the hinge axis is stationary.

6. The cosmetic case of claim 1 wherein the hinge is devoid of a physical hinge pin extending through said first and second plates.

7. The cosmetic case of claim 1 wherein said first and second magnets are cylindrical.

8. The cosmetic case of claim 7 wherein said first and second magnets are coaxial with the hinge axis.

9. The cosmetic case of claim 8 wherein the hinge is not bistable.

10. The cosmetic case of claim 1 wherein said first and second magnets are non-cylindrical.

11. The cosmetic case of claim 10 wherein said first and second magnets are rectangular parallelepiped.

12. The cosmetic case of claim 10 wherein said first and second magnets define a common hinge axis.

13. The cosmetic case of claim 11 wherein the hinge is at least bistable.

14. The cosmetic case of claim 13 wherein, in both of said bistable orientations, said first and second magnets are longitudinally aligned, essentially superposed, and in the same magnetic polar orientation, but with said first and second magnets relatively longitudinally realigned by 180°.

15. The cosmetic case of claim 1 wherein said first and second plates incorporate means to preclude movement of said first and second magnets transverse to the hinge axis while enabling independent pivotal movement of said first and second plates about the hinge axis.

16. The cosmetic case of claim 1 wherein said first and second plates define a pair of adjacent facing surfaces incorporating cooperating means to preclude movement of said first and second plates transverse to the hinge axis while enabling independent pivotal movement of said first and second plates about the hinge axis.

17. The cosmetic case of claim 16 wherein one of said adjacent facing surfaces defines a pin projecting towards the other adjacent facing surface, and said other adjacent facing surface defines an arcuate recess receiving said pin therein and constraining said pin to movement along said recess during pivoting of said plates relative to one another.

18. The cosmetic case of claim 16 additionally including at least one third plate of non-magnetic material disposed at least partially intermediate said first and second plates and incorporating means cooperating with said movement-precluding means of said first and second magnets for precluding non-pivotal movement of said at least one third plate relative to the hinge axis.

19. The cosmetic case of claim 1 wherein said plates are semi-cylindrical.

20. The cosmetic case of claim 19 wherein the hinge axis is adjacent one end of said plates and remote from the other end of said plates.

21. The cosmetic case of claim 1 additionally including removable means for maintaining said plates in said closed orientation.

22. The cosmetic case of claim 1 wherein one of said first and second magnets projects outwardly from the plane of its respective plate, and the other of said first and second magnets is recessed inwardly within the plane of its respective plate.

23. The cosmetic case of claim 1 wherein the hinge axis is disposed inwardly of the peripheries of said first and second plates in both said closed and open orientations.

24. In combination, a cosmetic case comprising a pair of hinges, each hinge according to the hinge of claim 1 and common means for maintaining the hinge axes of said pair of hinges in fixed spatial relationship, said first plates together in said closed orientation defining substantially a full cylinder, and said second plates together in said closed orientation defining substantially a full cylinder.

25. The combination of claim 24 wherein said first and second plates of one hinge are separately and independently pivotable relative to both said common means and said first and second plates of the other hinge.

26. The combination of claim 25 additionally including removable means to preclude pivoting of said first and second plates.

27. In combination, a cosmetic case comprising a pair of hinges, each hinge according to the hinge of claim 1 and common means for maintaining the hinge axes of said pair of hinges in fixed spatial relationship relative to one another, said first and second plates of one hinge being separately and independently pivotable relative to both said common means and said first and second plates of the other hinge.

28. The combination of claim 27 additionally including removable means to preclude pivoting of said first and second plates of said pair of hinges.

29. A cosmetic case having a magnetic hinge defining a hinge axis, comprising:

(A) as a base of said case, a first hinge plate of non-magnetic material;

(B) a first magnet disposed in said first plate for movement therewith;

(C) as a cover of said case, a second hinge plate of non-magnetic material; and (D) a second magnet disposed in said second plate for movement therewith;

said first and second plates being generally juxtaposed and independently pivotable about the hinge axis in respective parallel planes transverse to the hinge axis between:

(i) a closed orientation wherein said first and second plates are essentially superposed, and (ii) an open orientation wherein said first and second plates are essentially not superposed;

said first and second magnets incorporating means to preclude movement of said first and second magnets transverse to the hinge axis while enabling independent pivotal movement of said first and second plates about the hinge axis;

said first and second magnets being essentially superposed and in the same magnetic orientation;

said first plate and said first magnet being readily manually separable from said second plate and said second magnet to deconstruct said hinge, and said first plate and said first magnet being readily manually joinable with said second plate and said second magnet to reconstitute said hinge;

said first and second magnets being cylindrical and coaxial with the hinge axis such that said first and second plates are relatively pivotable about the hinge axis to a plurality of orientations intermediate said closed and open orientations;

the hinge axis being disposed inwardly of the peripheries of said first and second plates in both said closed and open orientations.

30. A cosmetic case having a magnetic hinge defining a hinge axis, comprising:

(A) as a base of said case, a first hinge plate of non-magnetic material;

(B) a first magnet disposed in said first plate for movement therewith;

(C) as a cover of said case, a second hinge plate of non-magnetic material; and (D) a second magnet disposed in said second plate for movement therewith; and (E) as a cosmetic carrier, at least one third hinge plate of non-magnetic material disposed at least partially intermediate said first and second plates;

said first, second and third plates being juxtaposed and independently pivotable about the hinge axis in respective parallel planes transverse to the hinge axis between:

(i) a closed orientation wherein said first, second and third plates are essentially superposed, and (ii) an open orientation wherein at least one of said first, second and third plates is essentially not superposed with the others;

said first and second magnets being essentially superposed, generally coaxial with the hinge axis, and in the same magnetic orientation.

31. The cosmetic case of claim 30 wherein each of said first and second magnets projects outwardly from the plane of its respective plate towards the other of said magnets, and said third plate defines an aperture there through aligned with the hinge axis, each of said first and second magnets having a projecting end in contact with the other magnet within said third plate aperture, and said third plate being pivotable about the hinge axis and the projecting ends of said first and second magnets.

32. The cosmetic case of claim 30 wherein said third plate incorporates means to preclude movement of said first and second magnets transverse to the hinge axis while enabling pivotal movement of said first, second and third plates about the hinge axis.

33. The cosmetic case of claim 30 characterized by the absence of a third magnet.

34. The cosmetic case of claim 30 wherein said first and second magnets incorporate means to preclude movement of said first and second magnets transverse to the hinge axis while enabling independent pivotal movement of said first, second and third plates about the hinge axis.

35. In combination, a cosmetic case comprising a pair of hinges, each hinge according to the hinge of claim 30, and common means for maintaining the hinge axes of said pair of hinges in fixed spatial relationship, said first plates together in said closed orientation defining substantially a full cylinder, said second plates together in said closed orientation defining substantially a full cylinder and said third plates together in said closed orientation defining substantially a full cylinder.

36. The combination of claim 35 wherein said common means comprises a common base and a pair of pins projecting upwardly from said common base in fixed spatial relationship, each said pin spatially fixing the hinge axis of a respective one of the hinges.

37. The combination of claim 36 wherein said pins are in close side-by-side juxtaposition.

38. The combination of claim 36 wherein said pins are at opposed ends of said common base.

39. The combination of claim 35 wherein said first, second and third plates of one hinge are separately and independently pivotable relative to both said common means and said first, second and third plates of the other hinge.

40. The combination of claim 39 additionally including removable means to preclude pivoting of said first, second and third plates.

41. A cosmetic case having a magnetic hinge defining a hinge axis, comprising:

(A) as a base of said case, a first hinge plate of non-magnetic material;

(B) a first magnet disposed in said first plate for movement therewith;

(C) as a cover of said case, a second hinge plate of non-magnetic material; and (D) a second magnet disposed in said second plate for movement therewith; and (E) as a cosmetic carrier, at least one third hinge plate of non-magnetic material disposed at least partially intermediate said first and second plates;

said first, second and third plates being generally juxtaposed and independently pivotable about the hinge axis in respective parallel planes transverse to the hinge axis between:

i. a closed orientation wherein said first, second and third plates are essentially superposed, and ii. an open orientation wherein at least one of said first, second and third plates is essentially not superposed with the others;

said first and second magnets being essentially superposed, generally coaxial with the hinge axis, and in the same magnetic orientation;

each of said first and second magnets projecting outwardly from the plane of its respective plate towards the other of said magnets, and said third plate defines an aperture there through aligned with the hinge axis, each of said first and second magnets having a projecting end in contact with the other magnet within said third plate aperture such that said third plate is pivotable about the hinge axis and the projecting ends of said first and second magnets, said third plate incorporating means to preclude movement of said first and second plates transverse to the hinge axis while enabling pivotal movement of said first, second and third plates about the hinge axis.

42. In combination, a cosmetic case comprising a pair of hinges, each hinge according to the hinge of claim 41 and common means for maintaining said common axes of said pair of hinges in fixed spatial relationship, said first, second and third plates together in said closed orientation defining substantially a full cylinder, said first, second and third plates of one hinge being separately and independently pivotable relative to both said common means and said first, second and third plates of the other hinge.

* * * * *